US011260666B2

(12) United States Patent
Morisue

(10) Patent No.: US 11,260,666 B2
(45) Date of Patent: Mar. 1, 2022

(54) LIQUID EJECTION HEAD AND LIQUID EJECTION APPARATUS

(71) Applicant: CANON KABUSHIKI KAISHA, Tokyo (JP)

(72) Inventor: Masafumi Morisue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/068,365

(22) Filed: Oct. 12, 2020

(65) Prior Publication Data

US 2021/0114378 A1 Apr. 22, 2021

(30) Foreign Application Priority Data

Oct. 16, 2019 (JP) ..... JP2019-189396

(51) Int. Cl.
*B41J 2/175* (2006.01)
*B41J 2/14* (2006.01)

(52) U.S. Cl.
CPC ..... *B41J 2/17596* (2013.01); *B41J 2/14* (2013.01); *B41J 2/17523* (2013.01)

(58) Field of Classification Search
CPC ..... B41J 2/17596; B41J 2/14; B41J 2/17523; B41J 2/1404; B41J 2202/12; B41J 2202/20; B41J 29/38
See application file for complete search history.

(56) References Cited

U.S. PATENT DOCUMENTS

2021/0114378 A1* 4/2021 Morisue ..... B41J 2/17596

FOREIGN PATENT DOCUMENTS

JP 2018518386 A 7/2018

* cited by examiner

*Primary Examiner* — Bradley W Thies
(74) *Attorney, Agent, or Firm* — Canon U.S.A., Inc., IP Division

(57) ABSTRACT

A liquid ejection head comprises a plurality of ejection orifices for ejecting liquid, a liquid supply flow path for supplying liquid to the plurality of ejection orifices and a plurality of branch flow paths branched from the liquid supply flow path each being held in communication with corresponding one of the plurality of ejection orifices. The plurality of ejection orifices form a first row and a second row each extending in parallel with each other. The first and second rows of ejection orifices are partially overlapping with each other as viewed in the direction orthogonal relative to the extending direction. The flow rate in the branch flow paths held in communication with the ejection orifices located in the overlapping part is made greater than the flow rate in the branch flow paths held in communication with the ejection orifices located in the non-overlapping part.

12 Claims, 10 Drawing Sheets

LIQUID EJECTION HEAD AND LIQUID EJECTION APPARATUS

BACKGROUND OF THE INVENTION

Field of the Invention

The present disclosure relates to a liquid ejection head and a liquid ejection apparatus.

Description of the Related Art

Currently, high speed image forming operations are required for inkjet recording apparatus that eject liquid (ink) from the ejection orifices of the ejection heads of the apparatus and record information in the form of images, which information may include character information, on recording mediums such as sheets of paper. From the viewpoint of satisfying the requirement of high speed image forming operations, inkjet recording apparatus equipped with a line head having a plurality of recording element substrates arranged in a row, each of which recording element substrates has a plurality of linearly arranged ejection orifices, are attracting attention. While one pass type inkjet printing methods of using such a line head are suited for high speed image forming operations, some of the ejection orifices may be driven to operate only rarely for liquid ejections depending on the images to be produced. When ejection orifices are driven to operate only rarely, the volatile component of the liquid to be ejected from such ejection orifices will evaporate to increase the viscosity of the liquid, giving rise to sedimentation of the pigment contained in the liquid and/or otherwise degrading the liquid. Such degradation on the part of the liquid results in an unintended rise or fall of ejection rate, unintended variations in the direction of ink ejection and other problems, which in turn ends up with images of degraded quality such as images with uneven density and striped images.

Techniques of constantly feeding the ejection orifices of a liquid ejection head with fresh liquid by circulating liquid within the liquid ejection modules of the liquid ejection head for the purpose of prevention of degradation of liquid are known. Japanese Patent Application Laid-Open No. 2018-518386 discloses a technique of arranging pump generators within the liquid recirculation channels for feeding the individual ejection orifices with liquid.

In line heads, a plurality of recording element substrates are arranged in a row and any two neighboring recording element substrates are generally disposed such that some of the ejection orifices of one of the two neighboring recording element substrates and the same number of ejection orifices of the other recording element substrate overlap each other as viewed in the recording medium conveying direction in order to prevent images with uneven density from being produced. With this arrangement, an image is formed by using the liquid ejected from the non-overlapping ejection orifices and the liquid ejected from overlapping ejection orifices and the liquid ejected from the overlapping ejection orifices is employed to average the image densities and reduce the density unevenness of the image. However, since many of the overlapping ejection orifices are involved in an image forming operation, the frequency of use of each of the overlapping ejection orifices is inevitably reduced. Therefore, there arises a need of prevention of viscosity rise of the liquid ejected from the overlapping ejection orifices.

SUMMARY OF THE INVENTION

A liquid ejection head according to the present disclosure comprises: a plurality of ejection orifices for ejecting liquid, a liquid supply flow path for supplying liquid to the plurality of ejection orifices and a plurality of branch flow paths branched from the liquid supply flow path, each of the plurality of branch flow paths being held in communication with corresponding one of the plurality of ejection orifices; the plurality of ejection orifices forming a first row of ejection orifices and a second row of ejection orifices extending in parallel with each other, each of the first row of ejection orifices and the second row of ejection orifices having an overlapping part overlapping with the corresponding overlapping part of the other row of ejection orifices and a non-overlapping part not overlapping with any of the ejection orifices of the other row of ejection orifices as viewed in the direction orthogonal relative to the first and second rows of ejection orifices, the plurality of branch flow paths including first branch flow paths held in communication with the ejection orifices located in the overlapping part and second branch flow paths held in communication with the ejection orifices located in the non-overlapping part; the flow rate of the liquid flowing through each of the first branch flow paths configured to be greater than the flow rate of the liquid flowing through each of the second branch flow paths.

Further features of the present disclosure will become apparent from the following description of exemplary embodiments with reference to the attached drawings.

DESCRIPTION OF THE EMBODIMENTS

Now, a liquid ejection head and a liquid ejection apparatus according to the present disclosure will be described in greater detail by way of currently preferable embodiments of the disclosure that are illustrated in the attached drawings. Note that each of the embodiments will be described in terms of the specific configuration of an inkjet recording apparatus in which a recording head or more than one recording head for ejecting ink, which is an exemplary liquid, is mounted.

Also note that, while the embodiments of the disclosure that are described below entails various technical limitations specific to the embodiments, such technical limitations do not limit the scope of the present invention by any means. In other words, the scope of the present invention is not limited by the embodiments and the technical specifics provided for the embodiments that are described in this specification, so far as they conform to the technical idea of the disclosure. In the attached drawings, the components that are functionally identical are denoted by same reference symbols and will not be described repeatedly.

(Liquid Ejection Head)

Figure 1:
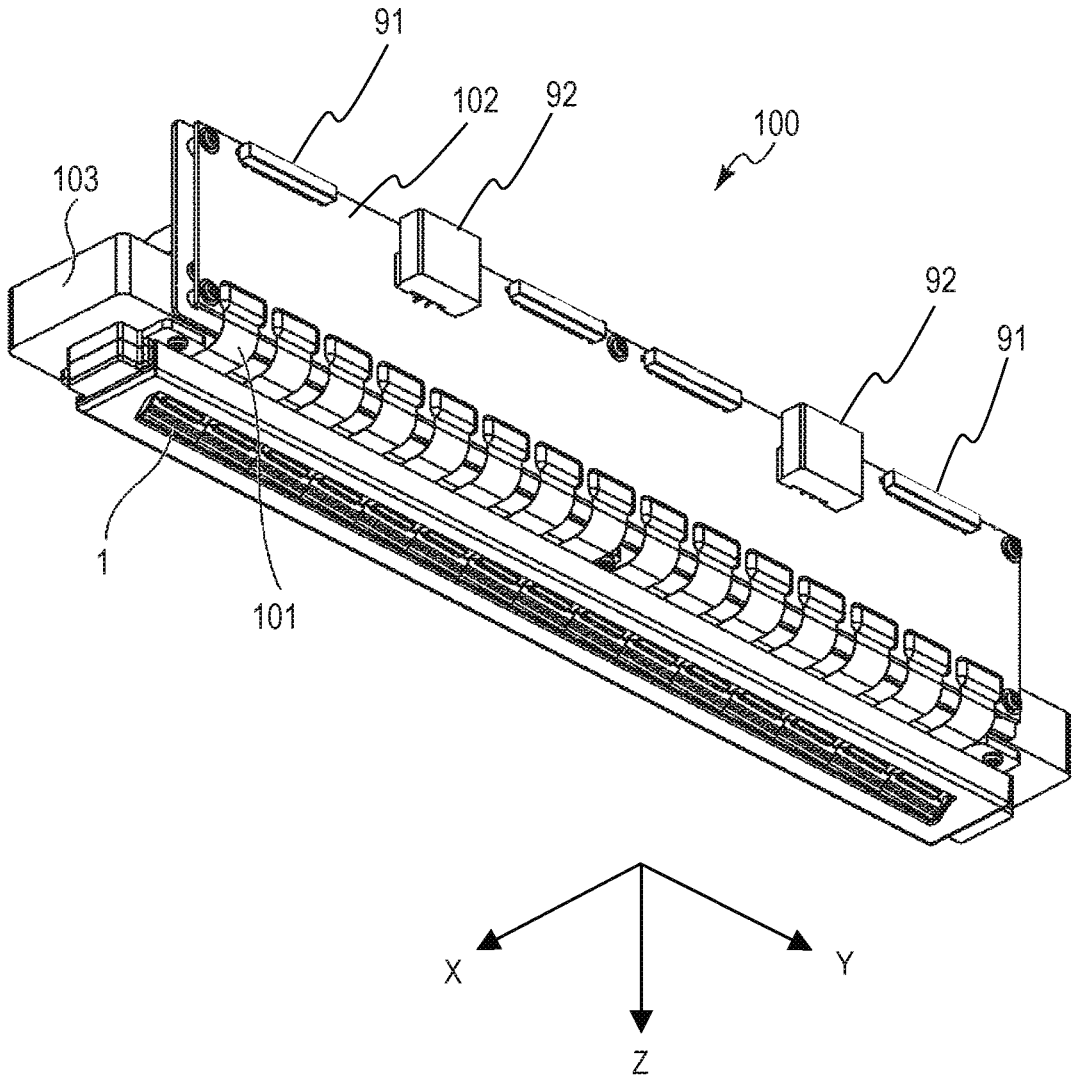
FIG. 1 is a schematic perspective view of an exemplary liquid ejection head, showing how it appears.
Figure 2A:
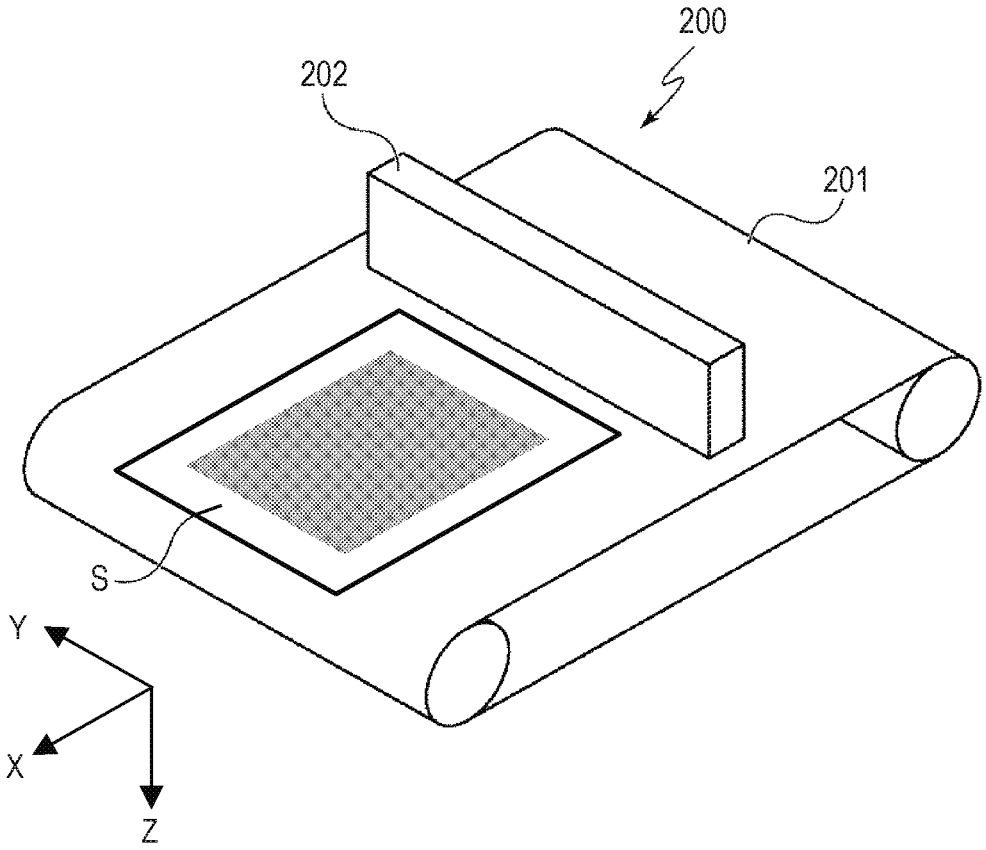
FIG. 2A is a schematic perspective view of an exemplary liquid ejection apparatus, showing how it appears.
Figure 2B:
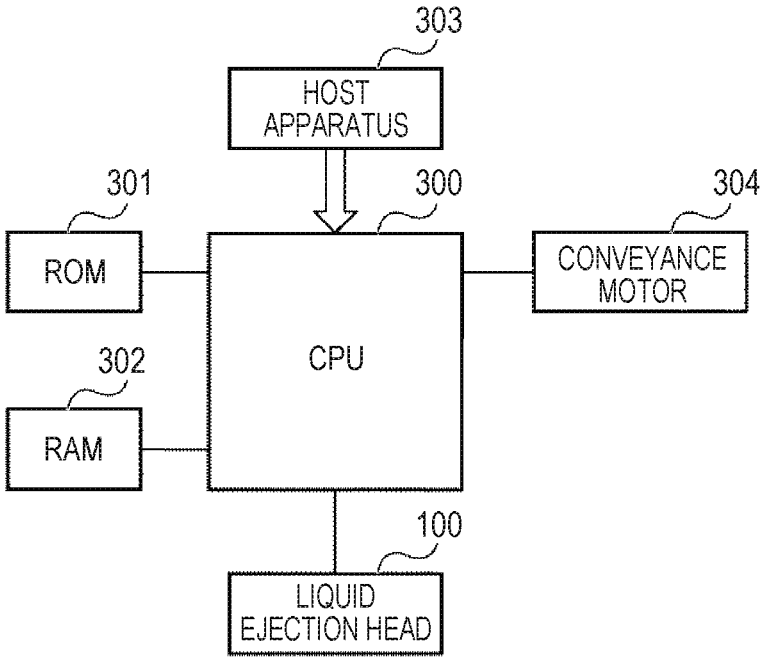
FIG. 2B is a control block diagram of the liquid ejection apparatus.

A liquid ejection head and a liquid ejection apparatus according to the present disclosure will summarily be described here by referring to FIGS. 1, 2A and 2B. FIG. 1 is a schematic perspective view of liquid ejection head 100. FIGS. 2A and 2B are a schematic conceptual illustration of liquid ejection apparatus 200. More specifically, FIG. 2A is a schematic perspective view of the liquid ejection apparatus, summarily showing its configuration, and FIG. 2B is a control block diagram of the liquid ejection apparatus. In the following description, the direction in which sheet S, which is an exemplar recording medium, is conveyed is defined as the X-direction and the longitudinal direction of the recording section 202 is defined as the Y-direction, while the direction that is orthogonal relative to both the X-direction and the Y-direction is defined as the Z-direction. As shown in FIG. 1, the liquid ejection head 100 has a plurality of recording element substrates 1, in each of which a plurality of ejection orifices for ejecting ink, which is an exemplary liquid, are highly densely arranged in the Y-direction. An energy generation element is or two or more energy generation elements are arranged so as to positionally correspond to each of the ejection orifices. The energy generation elements may be realized by using so many electrothermal conversion elements that can boil liquid (eating resistor elements, heater elements) or elements that can apply pressure to liquid by changing their volumes or by oscillating themselves (piezo (piezoelectric) elements). The plurality of recording element substrates 1 are arranged in a row running in the Y-direction. FIG. 1 shows a full-line type liquid ejection head 100, in which a plurality of recording element substrates 1 are arranged so as to extend over the entire width of the liquid ejection head, which width is equal to the width, or the length of the shorter sides, of an A4 size sheet of paper.

The liquid ejection head 100 has flexible wiring substrates 101 and an electric wiring board 102. The electric wiring board 102 in turn has signal input terminals 91 and power supply terminals 92. The signal input terminals 91 and the power supply terminals 92 are electrically connected to the CPU (central processing unit) 300 of the liquid ejection apparatus, which will be described in greater detail hereinafter. Ejection drive signals and electric power necessary for liquid ejections are supplied to the recording element substrates 1 (of the liquid ejection head 100) by way of these terminals. The individual recording element substrates 1 are electrically connected to the same and single electric wiring board 102 respectively by way of the flexible wining substrates 101. On the other hand, circulation flow paths are arranged in an ink supply unit 103 for the purpose of supplying ink, which ink is fed from liquid containers, or ink tanks, to the individual recording element substrates 1 and collecting the ink that is not consumed for the current recording operation. With the above-described arrangement, each of the ejection orifices arranged in the recording element substrates 1 is driven to eject ink supplied from the ink supply unit 103 in the Z-direction shown in FIG. 1 according to the ejection drive signal supplied by way of the flexible wring substrates 101, using electric power necessary for the ink ejection.

(Liquid Ejection Apparatus)

Now, a liquid ejection apparatus according to the present disclosure will be described below by referring to FIGS. 2A and 2B. As shown in FIG. 2A, the liquid ejection apparatus 200 comprises at least a conveyance means 201 and a recording section 202. The sheet S is conveyed right under the recording section 202 in the X-direction by the conveyance means 201 at a predetermined speed. The recording section 202 comprises as principal component a liquid ejection head 100 or two or more liquid ejection heads, which or each of which has a configuration same as the one described above by referring to FIG. 1, and a plurality of recording element substrates 1 are arranged in the Y-direction in the liquid ejection head 100 or in each of the liquid ejection heads 100 as described above by referring to FIG. 1. Ejection orifices, each of which is adapted to eject liquid in the color of cyan (C), magenta (M) yellow (Y) or black (K) as liquid droplets in the Z-direction, are arranged at a predetermined pitch on each of the recording element substrates 1. Note that an appropriate recording section 202 can selectively be employed for a recording operation of the liquid ejection apparatus 200 depending on the length of the recording medium in the Y-direction, the conveyance speed of the recording medium and other factors of the recording operation. For example, the recording section 202 may be a group of appropriately arranged liquid ejection heads 100.

As shown in FIG. 2B, the control section of the liquid ejection apparatus 200 comprises a CPU 300, a ROM (Read Only Memory) 301, a RAM (Random Access Memory) 302, a host apparatus 303 and a conveyance motor 304. The CPU 300 controls the entire liquid ejection apparatus 200 according to the control program stored in the ROM 301, using the RAM 302 as work area. For example, the CPU 300 executes a predetermined image processing operation on the image data it receives from the host apparatus 303 that is connected to an external data source according to the program stored in the ROM 301, using the parameters also stored in the ROM 301. Then, the CPU 300 generates ejection data for causing the liquid ejection head 100 or the liquid ejection heads 100 to eject liquid from the ejection orifices thereof. The liquid ejection head 100 is or the liquid ejection heads 100 are driven to operate according to the ejection data and the ejection orifices eject liquid at a predetermined frequency. During the liquid ejecting operation of the liquid ejection head 100 or the liquid ejection heads 100, the conveyance motor 304 drives the conveyance means 201 so as to convey the sheet S in the X-direction at a speed that matches the above-described predetermined frequency. Then, as a result, an image that corresponds to the image data received from the host apparatus 303 is recorded on the sheet S.

(Recording Element Substrate)

Figure 3A:
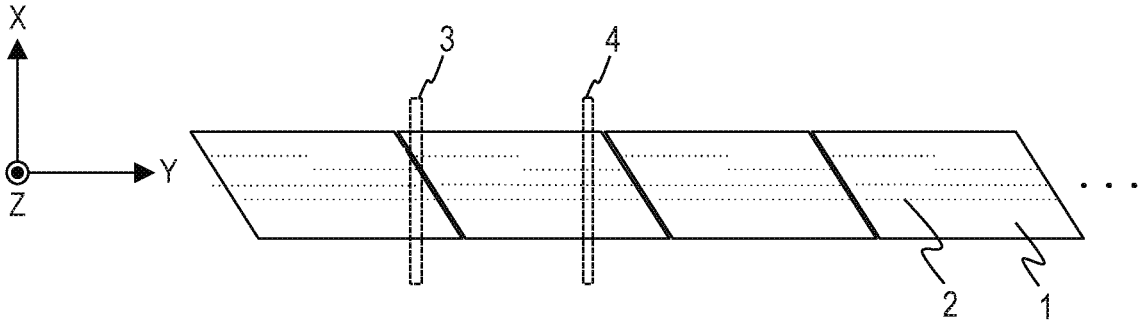
FIGS. 3A, 3B, 3C and 3D are illustrations of exemplar arrangements of the recording element substrates that can be employed for liquid ejection heads.
Figure 3B:
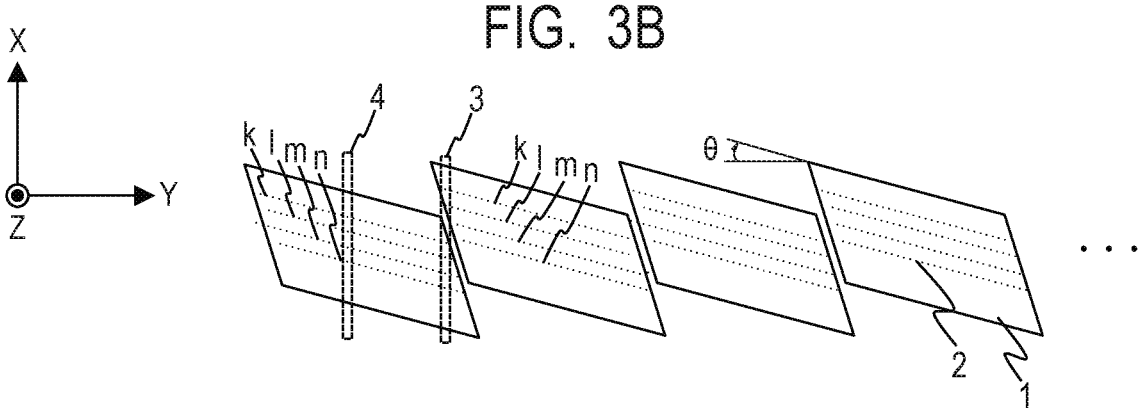
Figure 3C:
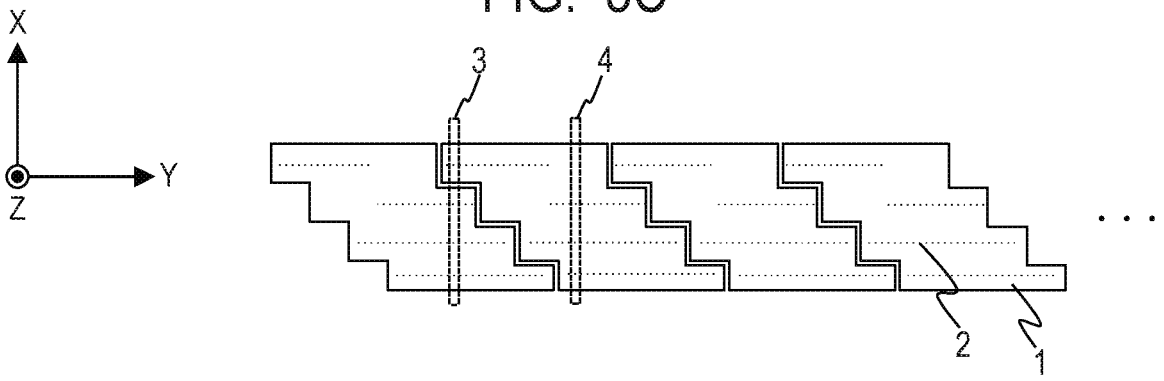
Figure 3D:
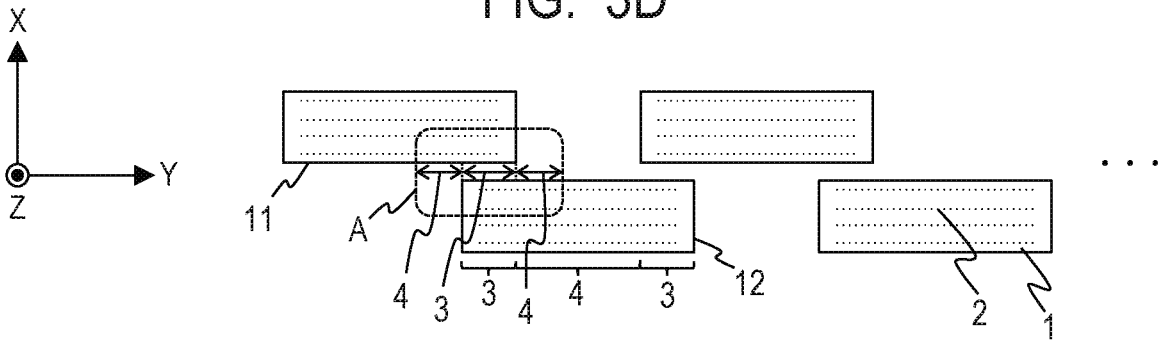

Now, recording element substrates according to the present invention will be described below by referring to FIGS. 3A through 3D. FIGS. 3A through 3D are schematic plan views of some of the recording element substrates 1 of a liquid ejection head according to the present invention, showing specific exemplar manners of arranging the recording element substrates 1 in the Y-direction. The recording element substrates 1 can be arranged in various different ways depending on the profile of the recording element substrates 1 and how the ejection orifices 2 are arranged in the recording element substrates 1. FIGS. 3A through 3D show typical arrangements for recording element substrates 1. FIG. 3A shows recording element substrates 1 having a profile of a parallelogram and arranged to form a single row of recording element substrates 1 such that the plurality of rows of ejection orifices 2 in the recording element substrates 1 are made to extend to cross the boundaries of the recording element substrates 1 in the Y-direction and the mutually corresponding ejection orifices of the different rows are aligned in the X-direction. FIG. 3B also shows recording element substrates 1 same as those of FIG. 3A that are arranged to form a single row of recording element substrates 1 but each of the recording element substrates 1 is tilted clockwise by an angle of θ from the Y-direction. FIG. 3C shows recording element substrates 1 whose lateral edges as viewed in the X-direction have a stepped profile and who are arranged such that the neighboring lateral edges having a stepped profile of any two adjacently located recording element substrates 1 snugly fit to each other and all the recording element substrates 1 are precisely aligned in a single row in the Y-direction. FIG. 3D shows recording element substrates 1 having a rectangular profile. Of the recording element substrates having a rectangular profile as shown in FIG. 3D, any two neighboring recording element substrates 1 are located side by side and slightly shifted from each other in the X-direction such that the plurality of rows of ejection orifices 2 running in parallel in the Y-direction of the two neighboring recording element substrates 1 are made to partly overlap as viewed in the X-direction. In other words, the recording element substrates 1 of FIG. 3D are arranged in a staggered manner. In the following description, the parts of two adjacently located recording element substrates 1 where their ejection orifices 2 overlap each other are referred to as overlapping parts 3, whereas the parts of two adjacently located recording element substrates 1 where their ejection orifices 2 do not overlap each other are referred to as non-overlapping parts 4.

In the instance of the recording element substrates 1 shown in FIG. 3A and those shown in FIG. 3C, the ejection orifices of the uppermost row of each of the recording element substrates 1 are divided into two halves including an upper half and a lower half as viewed in the X-direction. Thus, the uppermost row of the recording element substrates 1 is made to be a staggered row as a whole. Then, the overlapping part 3 shown in both FIG. 3A and FIG. 3C has four ejection orifices 2 arranged in the X-direction and the four ejection orifices 2 are driven to eject liquid in each and every image forming operation of the liquid ejection head, whereas the non-overlapping part 4 shown in both FIG. 3A and FIG. 3C has only three ejection orifices 2 arranged in the X-direction and the three ejection orifices 2 are driven to eject liquid in each and every image forming operation of the liquid ejection head. Therefore, the frequency of use of the ejection orifices 2 of the overlapping part 3 and the frequency of use of the ejection orifices 2 of the non-overlapping part 4 differ from each other. In the instance of the recording element substrates 1 shown in FIG. 3B, the ejection orifices 2 of the uppermost row, or the first row, are driven to eject liquid of color k and the ejection orifices 2 of the second row are driven to eject liquid of color 1, while the ejection orifices 2 of the third row are driven to eject liquid of color m and the ejection orifices 2 of the lowermost row, or the fourth row, are driven to eject liquid of color n. The number of ejection orifices 2 for each color of the overlapping part 3 is greater than the number of ejection orifices 2 for each color of the non-overlapping part 4. Therefore, again, the frequency of use of the ejection orifices 2 of the overlapping part 3 and the frequency of use of the ejection orifices 2 of the non-overlapping part 4 differ from each other.

In each of the embodiments that will be described below, the recording element substrates 1 of the liquid ejection head 100 may typically be arranged in a staggered manner as shown in FIG. 3D so as to produce overlapping parts 3 and non-overlapping parts 4 and extend in the Y-direction as a whole. Note, however, that the manner in which the recording element substrates 1 of a liquid ejection head 100 according to the present disclosure are arranged is by no means limited to such a staggered arrangement. Each of the embodiments that will be described below is a full-line type liquid ejection head 100. Note, however again, that a liquid ejection head 100 according to the present invention may alternatively be a compact type liquid ejection head having only a single recording element substrate 1 (ejection chip) or a small number of recording element substrates 1. Then, a plurality of such liquid ejection heads are incorporated into a liquid ejection apparatus so as to be driven to move on a serial basis.

First Embodiment

Figure 4:
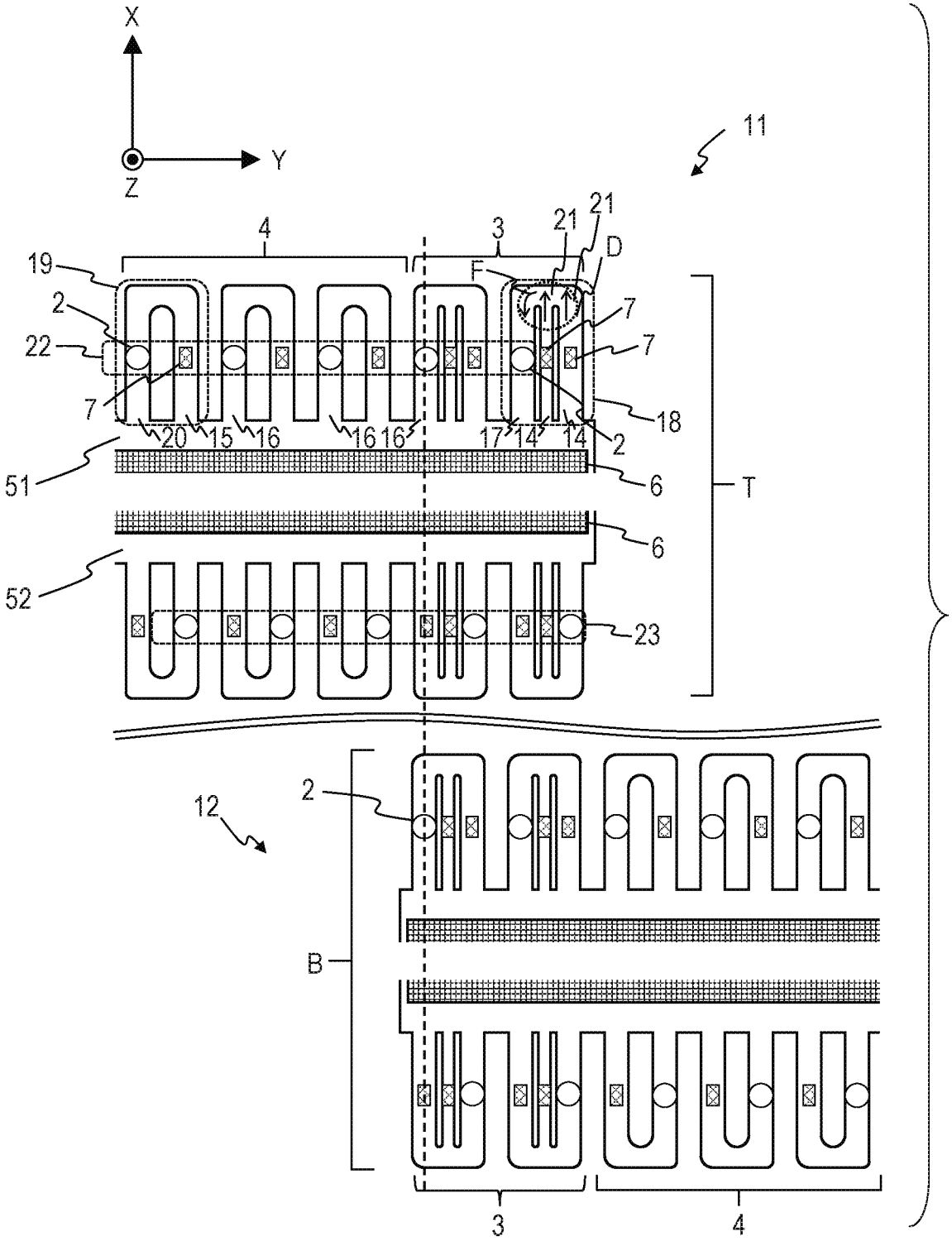
FIG. 4 is an enlarged schematic plan view of the overlapping parts and the non-overlapping parts of two neighboring recording element substrates of the first embodiment of liquid ejection head according to the present disclosure.

The configuration of the overlapping parts and the configuration of the non-overlapping parts of the recording element substrates arranged in the first embodiment of liquid ejection head according to the present disclosure will be described below by referring to FIG. 4. FIG. 4 is an enlarged schematic illustration of some of the recording element substrates of this embodiment having overlapping parts and non-overlapping parts. Only a small number of ejection orifices 2 are shown there. More specifically, FIG. 4 is an enlarged view of the part of the recording element substrate 11 surrounded by a dotted line A shown in FIG. 3D. In FIG. 4, the upper part T corresponds to the part of the recording element substrate 11 found in the area surrounded by the dotted line A in FIG. 3D, whereas the lower part B corresponds to the part of the recording element substrate 12 also found in the area surrounded by the dotted line A in FIG. 3D. In other words, FIG. 4 shows two rows of ejection orifices 2 that belong to the recording element substrate 11 and two rows of ejection orifices 2 that belong to the recording element substrate 12 that is adjacently located relative to the recording element substrate 11. In FIG. 4, the ejection orifices of each of the rows of ejection orifices include those that belong to an overlapping part 3 and those that belong to a non-overlapping part 4. In the overlapping part 3 shown in FIG. 4, each of the rows of ejection orifices of the recording element substrate 11 has a part that exactly overlaps its counterpart of the corresponding row of ejection orifices of the recording element substrate 12 located right below it as viewed in the X-direction that is orthogonal relative to the rows of ejection orifices. In each of the non-overlapping parts 4 shown in FIG. 4, both of the rows of ejection orifices of the recording element substrate 11 do not have any row of ejection orifices of the recording element substrate 12 located right below as viewed in the X-direction that is orthogonal relative to the rows of ejection orifices. Since the configuration of the recording element substrate 11 is exactly same as that of the recording element substrate 12, the configuration of only the recording element substrate 11 will be described below.

In the recording element substrate 11 shown in FIG. 4, the first row of ejection orifices 22 and the second row of ejection orifices 23 are arranged in parallel with each other and extend in the Y-direction. A first liquid supply flow path 51 for supplying liquid to the ejection orifices 2 of the first row of ejection orifices 22 and a second liquid supply flow path 52 for supplying liquid to the ejection orifices 2 of the second row of ejection orifices 23 are arranged between the first row of ejection orifices 22 and the second row of ejection orifice 23. Additionally, a pair of supply ports 6 for supplying liquid to the first liquid supply flow path 51 and the second liquid supply flow path 52 are formed between the first row of ejection orifices 22 and the second row of ejection orifices 23. Furthermore, a plurality of branch flow paths 16 are branched from the first and second liquid supply flow paths 51, 52 and the branch flow paths 16 branched from the first liquid supply flow path 51 are held in communication with the ejection orifices 2 of the first row of ejection orifices 22, while the branch flow paths 16 branched from the second liquid supply flow path 52 are held in communication with the ejection orifices 2 of the second row of ejection orifices 23. The branch flow paths 16 include the first branch flow paths 14 that are held in communication with the ejection orifices 2 located in the overlapping part 3 and the second branch flow paths 15 that are held in communication with the ejection orifices 2 located in the non-overlapping part 4.

Referring to FIG. 4, the overlapping part 3 can be divided into plural blocks, each having a first circulation flow path 18 in it, and only one of the illustrated blocks of the uppermost row of ejection orifices will be described below because all the blocks are identical in terms of configuration and the description given below is equally applicable to all the remaining blocks. The first circulation flow path 18 is formed by a first branch flow path 14 and a first merging flow path 17. In other words, the first merging flow path 17 and the first branch flow path 14 are combined to form a first circulation flow path 18. The first merging flow path 17 is connected to the first branch flow path 14. The first merging flow path 17 has an ejection orifice 2 in it. The first branch flow path 14 eventually joins the first liquid supply flow path 51. Pump elements 7 for circulating the liquid in the first circulation flow path 18 to the ejection orifice 2 are formed in the first circulation flow path 18. The first branch flow path 14 has plural sub flow paths 21 that run in parallel and each of the sub flow paths 21 has a pump element 7 arranged in it.

Also referring to FIG. 4, the non-overlapping parts 4 can be divided into plural blocks, each having a second circulation flow path 19 in it, and only one of the illustrated blocks of the upper row of ejection orifices will be described below because all the blocks are identical in terms of configuration and the description given below is equally applicable to all the remaining blocks. The second circulation flow path 19 is formed by a second branch flow path 15 and a second merging flow path 20. In other words, a second merging flow path 20 and a second branch flow path 15 are combined to form a second circulation flow path 19. The second merging flow path 20 is connected to the second branch flow path 15. The second merging flow path 20 has an ejection orifice 2 in it. The second branch flow path 15 eventually joins the first liquid supply flow path 51. A pump element 7 for circulating the liquid in the second circulation flow path 19 to the ejection orifice 2 is formed in the second circulation flow path 19.

When, for instance, the pump elements 7 are formed by using so many heating resistor elements, circulating force F drives liquid to move and flow in the directions indicated by arrows surrounded by a circle of a dotted line D in FIG. 4 due to the behavior of the bubbles generated by the heating resistor elements. Thus, liquid can be driven to circulate in the first circulation flow path 18 and fresh liquid can constantly be supplied to the ejection orifice 2 by driving the pump elements 7 even when the frequency of use of the ejection orifice 2 is low. Then, as a result, the risk of degradation of liquid such as viscosity rise and/or sedimentation of pigment can be minimized.

Referring again to FIG. 4, only a single ejection orifice 2 is arranged in the X-direction in the non-overlapping part 4 of the recording element substrate 11 and also in the non-overlapping part 4 of the recording element substrate 12, whereas two ejection orifices 2 are arranged in the X-direction in the overlapping part 3. Thus, the plurality of ejection orifices 2 arranged in the X-direction in the overlapping part 3 are employed to eject liquid droplets toward the same pixel part. Therefore, each of the ejection orifices 2 formed in the overlapping part 3 is less frequently driven to eject liquid droplets if compared with each of the ejection orifices 2 formed in the non-overlapping part 4 and hence each of ejection orifices 2 in the overlapping part 3 is forced to have a prolonged undriven period of time for ejecting liquid droplets if compared with each of the ejection orifices 2 formed in the non-overlapping part 4. Then, such a prolonged undriven period of time can result in raised risk of degradation of liquid such as viscosity rise and/or sedimentation of pigment.

In this embodiment, the flow rate of the liquid circulating between the first branch flow path 14 of the first circulation flow path 18 and the first liquid supply flow path 51 in the overlapping part 3 is greater than the flow rate of the liquid circulating between the second branch flow path 15 of the second circulation flow path 19 and the first liquid supply flow path 51 in the non-overlapping part 4. More specifically, the number of pump elements 7 in the first circulation flow path 18 of the overlapping part 3, in which the frequency of use of each of the ejection orifices 2 is low, is greater than the number of pump elements 7 in the second circulation flow path 19 of the non-overlapping part 4. In other words, as shown in FIG. 4, twice as many pump elements 7 as the pump elements 7 arranged in the second circulation flow path 19 are arranged in the first circulation flow path 18. More specifically, a pump element 7 is arranged in each of the plurality of sub flow paths 21 of the first branch flow path 14.

As described above, the flow rate of the liquid circulating through the first circulation flow path 18 is made greater than the flow rate of the liquid circulating through the second circulation flow path 19 in this embodiment. Differently stated, the flow speed of the liquid circulating through the first circulation flow path 18 is made greater than the flow speed of the liquid circulating through the second circulation flow path 19. Then, as a result, the risk of liquid viscosity rises in the overlapping part 3 is minimized to in turn minimize the risk of producing images with uneven density and striped images by the liquid ejected from this embodiment of liquid ejection head. Therefore, the liquid ejection apparatus 200 in which the liquid ejection head 100 of this embodiment is mounted can form high quality images.

While a single pump element 7 is arranged for each of the ejection orifices 2 in the non-overlapping part 4 and a pair of pump elements 7 are arranged for each of the ejection orifices 2 in the overlapping part 3 in the above description of this embodiment, the present invention is by no means limited to such an arrangement. What is essential is that the number of pump elements 7 provided for each of the ejection orifices 2 in the overlapping part 3 needs to be greater than the number of pump elements 7 provided for each of the ejection orifices 2 in the non-overlapping part 4. When the ratio of the number of ejection orifices 2 to the number of pump elements 7 in the overlapping part 3 is assumed to be 1:N and the ratio of the number of ejection orifices 2 to the number of pump elements 7 in the non-overlapping part 4 is assumed to be 1:M, N and M (where both N and M are integers not smaller than 2) are only required to satisfy the relationship requirement of N>M.

Second Embodiment

Now, the configuration of the overlapping parts and the configuration of the non-overlapping parts of the recording element substrates arranged in the second embodiment of liquid ejection head according to the present disclosure will be described below by referring to FIG. 5. The recording element substrates 1 of this embodiment structurally differ from the recording element substrates 1 of the first embodiment in terms of the following points. The first point of difference is that, while first circulation flow paths 18 having pump elements 7 for driving liquid to circulate and move to the ejection orifices 2 are formed in each of the overlapping parts 3, no second circulation flow paths 19 having pump elements 7 for driving liquid to circulate and move to the ejection orifices 2 are formed in each of the non-overlapping parts 4. The second point of difference is that each of the second merging flow paths 20 of the non-overlapping part 4 has a dead end behind the ejection orifice 2 arranged in the second merging flow path 20. When M and N as defined above in the description of the first embodiment are also employed here, this embodiment has relationship requirements to be satisfied of M=0 and N≠0.

Additionally, while two pump elements 7 are provided to drive liquid to circulate for the ejection orifice 2 in each of the first circulation flow paths 18 of the first embodiment, only a single pump element 7 is provided to drive liquid to circulate for the two ejection orifices 2 in each of the first circulation flow paths 18 of this embodiment. Like circulating force F described above for the first embodiment, circulating force F drives liquid to move and flow in the directions indicated by arrows surrounded by a circle of a dotted line E in FIG. 5 due to the behavior of the bubbles generated by the heating resistor element constituting the pump elements 7.

Figure 5:
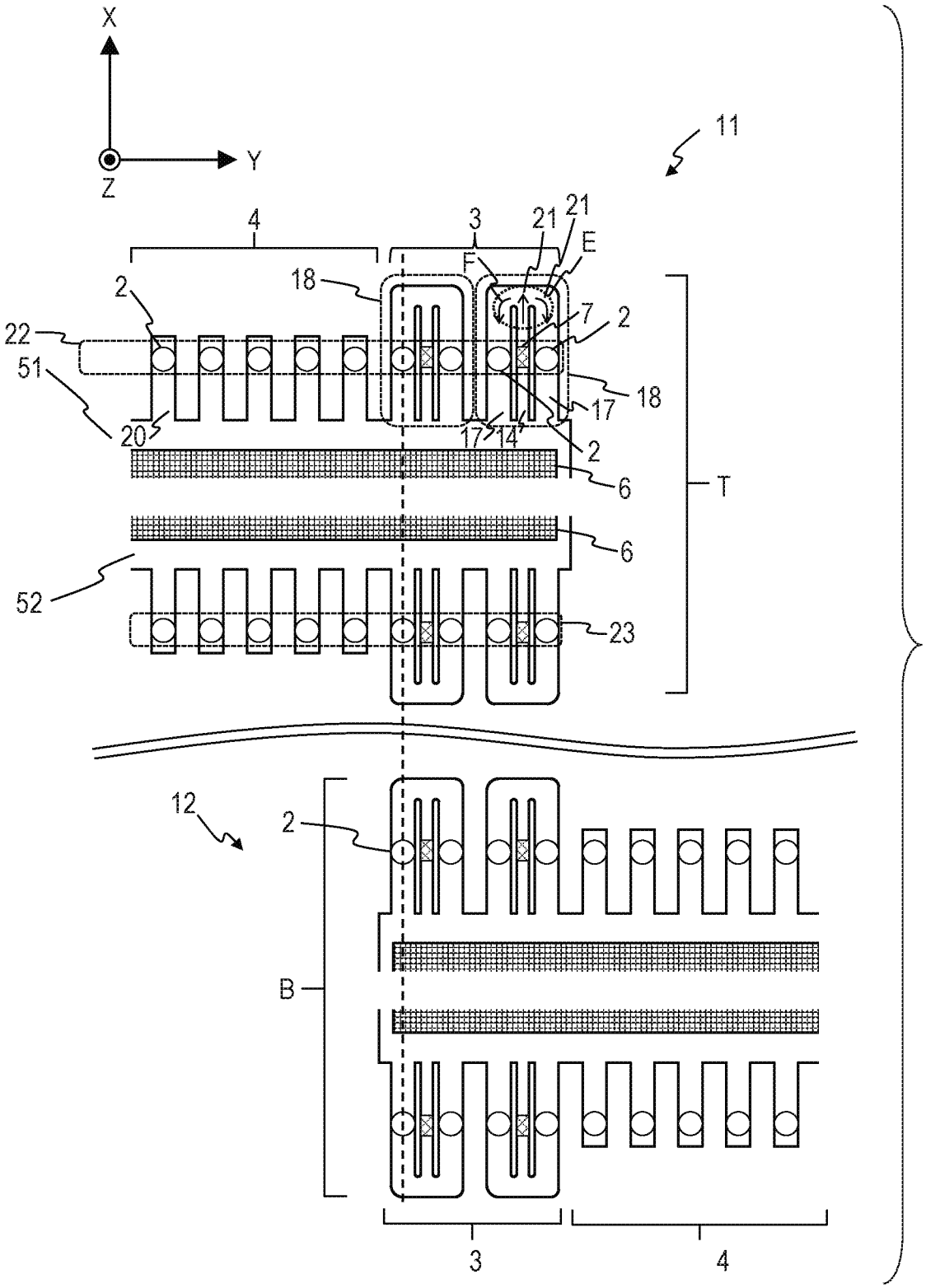
FIG. 5 is an enlarged schematic plan view of the overlapping parts and the non-overlapping parts of two neighboring recording element substrates of the second embodiment of liquid ejection head according to the present disclosure.

Referring to FIG. 5, two ejection orifices 2 are arranged in the vertical direction that agrees with the X-direction in the non-overlapping part 4 of the recording element substrate 11 and also in the non-overlapping part 4 of the recording element substrate 12, whereas four ejection orifices 2 are arranged in the vertical direction in the overlapping part 3. When forming an image on a recording medium by means of this embodiment, the plurality of ejection orifices 2 arranged in the vertical direction that agrees with the X-direction are driven to eject liquid droplets to a single pixel part. Thus, in this embodiment, only each of the first circulation flow paths 18 of the overlapping parts 3 is provided with a pump element 7 for the purpose of raising the flow rate of circulating liquid in the overlapping parts 3.

In this embodiment, the flow rate of the liquid circulating in the overlapping parts 3 is made greater than the flow rate of the liquid circulating in the non-overlapping parts 4 by arranging pump elements 7 only in the overlapping parts 3. Thus, with this arrangement, the risk of liquid viscosity rise in the overlapping parts 3 can be minimized and therefore the risk of producing images with uneven density and striped images by the liquid ejected from this embodiment of liquid ejection head can also be minimized. Additionally, the configuration of the recording element substrates 11 and that of the recording element substrate 12 can be simplified as a result of using a reduced number of pump elements 7. Therefore, the liquid ejection apparatus 200 in which the liquid ejection head 100 of this embodiment is mounted can form high quality images.

Modified Embodiment

Now, an embodiment obtained by modifying the configuration of the overlapping parts and the configuration of the non-overlapping parts of the recording element substrates arranged in the liquid ejection head of the second embodiment will be described below by referring to FIG. 6. The recording element substrates 1 of this modified embodiment structurally differ from the recording element substrates 1 of the above-described second embodiment in terms of the following points. The first point of difference is that a plurality of first circulation flow paths 18, each having a pump element 7 for driving liquid to circulate to the related ejection orifices 2, are formed in each of the overlapping parts 3 and each of the first circulation flow paths 18 is made to have plural first merging flow paths 17, which share a single branch flow path 14. The second point of difference is that the first branch flow path 14 is located at one of the opposite ends of the first circulation flow path 18 as viewed in the Y-direction. More specifically, the first branch flow path 14 is located at the outside of the first row of ejection orifices 22. As a result of arranging the pump elements 7 at one of the opposite ends of the first circulation flow path 18 as viewed in the Y-direction (outside the first row of ejection orifices 22), the Y-directional length of the part of the first circulation flow path 18 other than the first branch flow path 14 (the first merging flow paths 17) is made to be freely adjustable. Thus, this modified embodiment provides an advantageous effect that the number of ejection orifices 2 on the first circulation flow paths 18 of the overlapping part 3 can freely be increased or decreased in addition to the advantageous effects of the second embodiment.

Additionally, in the first circulation path 18 of the overlapping part 3 in this modified embodiment, the pump element 7 is arranged at the outside of the first row of ejection orifices 22 and the ejection orifices 2 are arranged not on the first branch flow path 14 where the pump element 7 is arranged but on the first merging flow paths 17. In other words, unlike the second embodiment, in which a pump element 7 is arranged between each pair of adjacently located ejection orifices 2 as viewed in the Y-direction, the gap between the pump element 7 and the most closely located ejection orifice 2 can be made equal to the gap between any two adjacently located ejection orifices 2. Differently stated, this modified embodiment does not require any high precision positioning for the pump elements 7 and allows the recording element substrates 1 to be manufactured with relative ease and a high yield to be achieved in the steps of manufacturing the recording element substrates 1.

Figure 6:
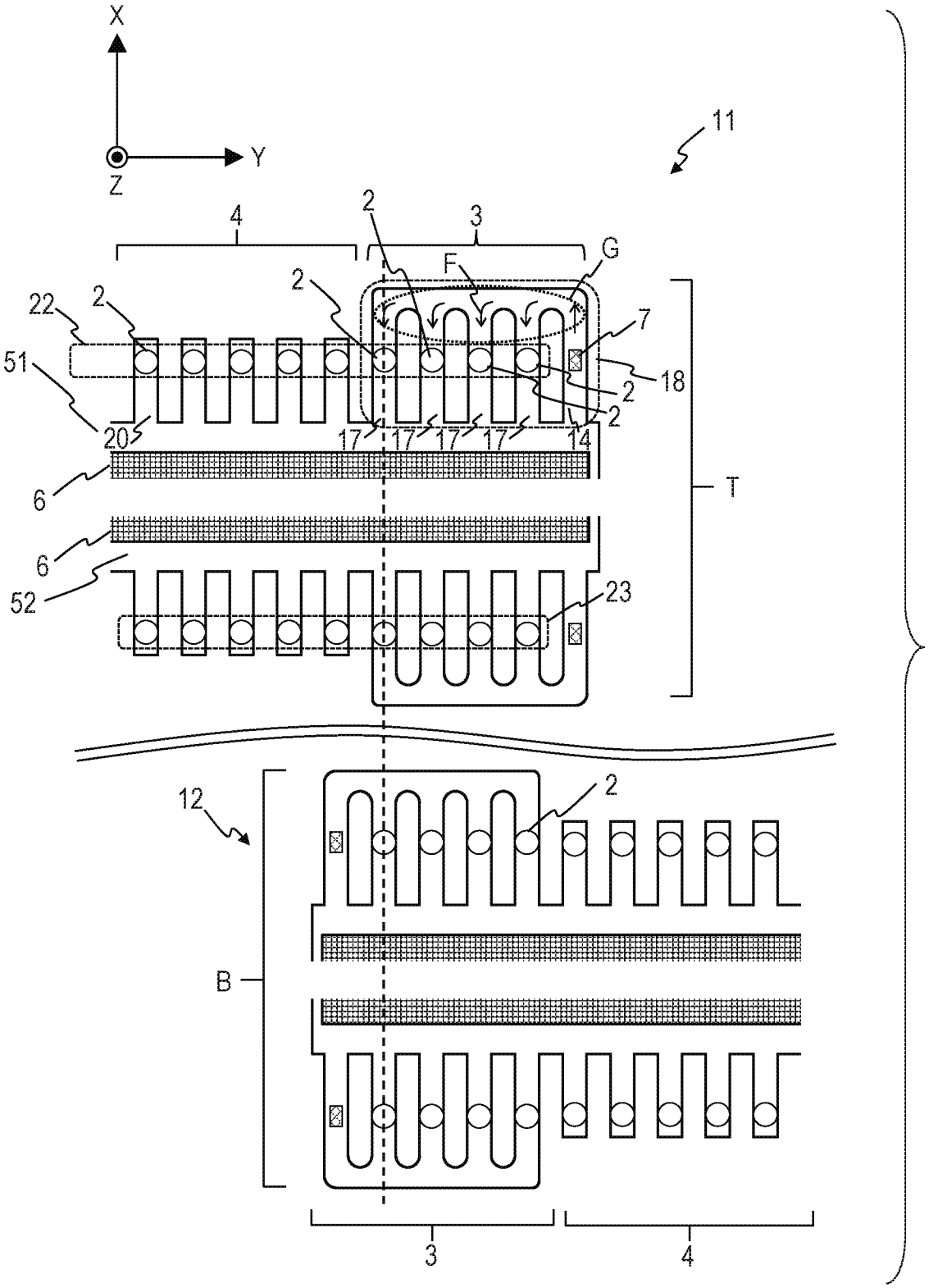
FIG. 6 is an enlarged schematic plan view of the overlapping parts and the non-overlapping parts of two neighboring recording element substrates of an embodiment obtained by modifying the second embodiment of liquid ejection head according to the present disclosure.

Like circulating force F described above for the first and second embodiments, circulating force F of this modified embodiment drives liquid to move and flow in the directions indicated by arrows surrounded by a circle of a dotted line G in FIG. 6 due to the behavior of the bubbles generated by the heating resistor element that constitutes the pump element 7. Note that the profile of the first circulation flow paths 18, the number of pump elements 7 and so on described above for the second embodiment and the modified second embodiment are freely modifiable and can appropriately be determined by taking the performance of the pump elements 7, the frequency of use of the individual ejection orifices 2 and other factors into consideration.

Third Embodiment

Figure 7A:
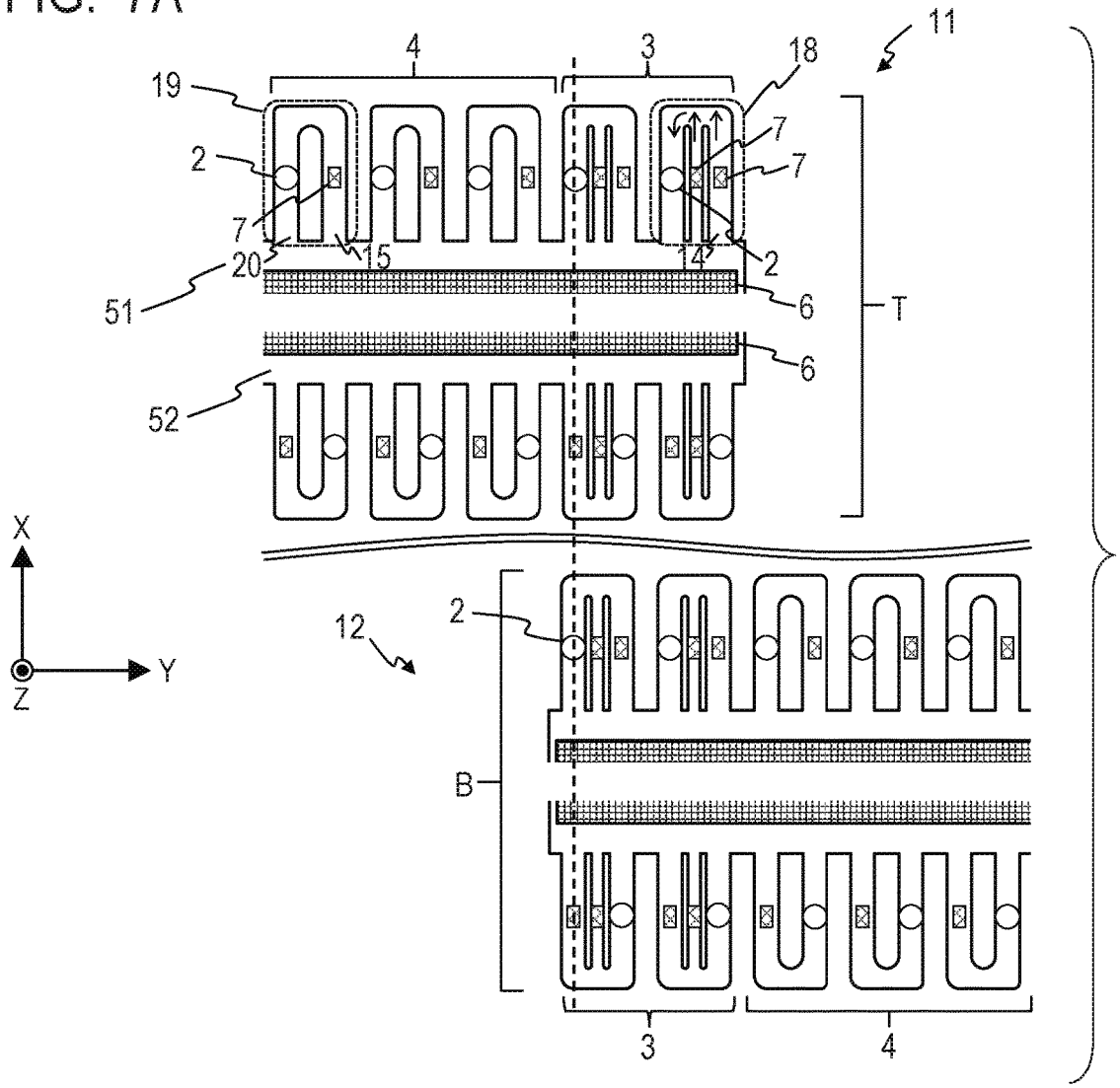
FIG. 7A is an enlarged schematic plan view of the overlapping parts and the non-overlapping parts of two neighboring recording element substrates of the third embodiment of liquid ejection head according to the present disclosure and FIG. 7B is a schematic illustration of the drive voltages of the overlapping parts and the drive voltage of the non-overlapping parts of the recording element substrates of the third embodiment of liquid ejection head.
Figure 7B:
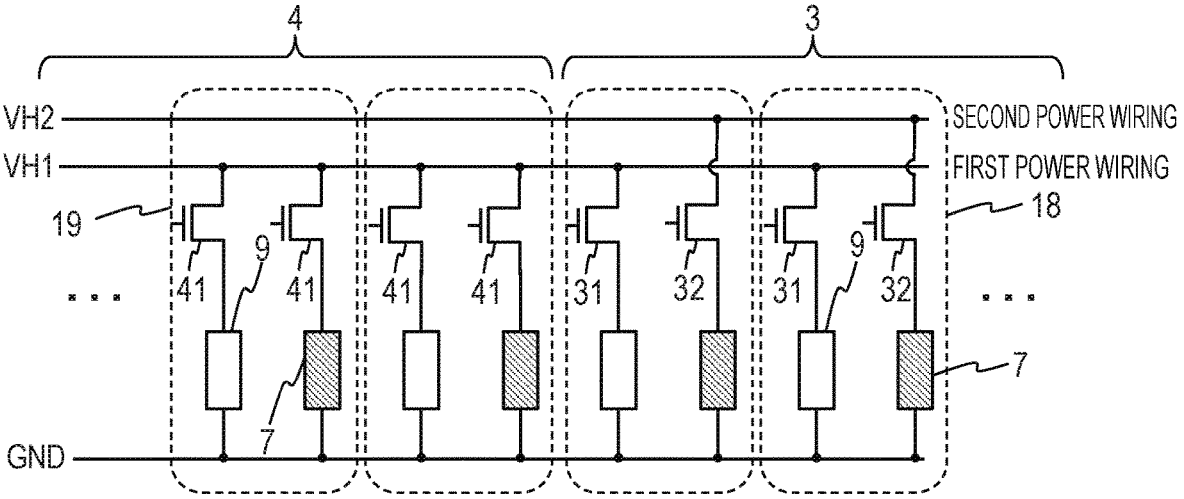

Now, the configuration of the overlapping parts and the configuration of the non-overlapping parts of the recording element substrates arranged in the third embodiment of liquid ejection head according to the present disclosure will be described below by referring to FIGS. 7A and 7B. FIG. 7A is an enlarged schematic plan view of only one of the overlapping parts and the non-overlapping parts connected to the overlapping part of the recording element substrates similar to those described above for the first embodiment (by referring to FIG. 4). FIG. 7B is a schematic illustration of the drive voltages applied to liquid ejection elements of the overlapping parts and the drive voltage applied to the liquid ejection elements of the non-overlapping parts of the recording element substrates of the third embodiment. Note that each of the liquid ejection elements 9 shown in FIG. 7B is an energy generation element arranged to positionally correspond to an ejection orifice 2 and hence each of the ejection orifices 2 and the corresponding one of the liquid ejection elements 9 will be described as an inseparable pair.

As shown in FIGS. 7A and 7B, a plurality of second circulation flow paths 19, each having a pump element 7 and an ejection orifice 2 (accompanied by a liquid ejection element 9), are arranged in each of the non-overlapping parts 4. On the other hand, a plurality of first circulation flow paths 18, each having a pair of pump elements 7 and an ejection orifice 2 (accompanied by a liquid ejection element 9), are arranged in each of the overlapping parts 3. As shown in FIG. 7B, drive voltage 1 (VH1) is applied to the pump element 7 and the liquid ejection element 9 of each of the circulation flow paths 19 in the non-overlapping parts 4. On the other hand, drive voltage 1 (VH1) is applied to the liquid ejection element 9 and drive voltage 2 (VH2) is applied to each of the pump elements 7 of each of the first circulation flow paths 18 in the overlapping parts 3. Each of the recording element substrates 1 has first power wiring and second power wiring and the drive voltage set for the first power wiring differs from the drive voltage set for the second power wiring. Drive voltage 1 (VH1) is applied to the first power wiring and drive voltage 2 (VH2) is applied to the second power wiring.

As shown in FIG. 7B, in each of the second circulation flow paths 19 in the non-overlapping parts 4, the pump element 7 is connected between the drive voltage for the first power wiring (VH1) and GND (ground) by way of a switching element 41 for driving the pump element 7 and, similarly, the liquid ejection element 9 is connected between the drive voltage for the first power wiring (VH1) and GND (ground) by way of a switching element 41 for driving the liquid ejection element 9. The switching elements 41 may typically be so many MOS (Metal Oxide Semiconductor) transistors. In each of the first circulation flow paths 18 in the overlapping part 3, the liquid ejection element 9 is connected between the drive voltage for the first power wiring (VH1) and GND (ground) by way of a switching element 31 for driving the liquid ejection element 9. In each of the first circulation flow paths 18 in the overlapping part 3, each of the pump elements 7 is connected between the drive voltage for the second power wiring (VH2) and GND (ground) by way of a switching element 32 for driving the pump element 7.

Note that the drive voltage 1 (VH1) and the drive voltage 2 (VH2) satisfy the relationship requirement of VH1<VH2. The first power wiring and the second power wiring are connected to the power wiring (not shown) formed in each of the recording element substrates 1 and each of the elements is driven to operate on the basis of the electric power supplied to the liquid ejection head from the outside. Note that, while the same drive voltage 1 (VH1) is applied to both the liquid ejection elements 9 and the pump elements 7 in the non-overlapping parts 4 in this embodiment, the drive voltage for driving the liquid ejection elements 9 is not limited to the drive voltage 1 (VH1) and some other voltage may alternatively be employed. What is important here is that the drive voltage 2 (VH2) that is applied to the pump elements 7 in the overlapping parts 4 is higher than the drive voltage 1 (VH1) that is applied to the pump elements 7 in the non-overlapping parts 4.

Thus, in this embodiment, the calorific value of the heat that each of the pump elements 7 generates in the overlapping parts 3 is made greater than the calorific value of the heat that each of the pump elements 7 generates in the non-overlapping parts 4 as a result of that the drive voltage 2 (VH2) of the pump elements 7 in the overlapping parts 3 is made higher than drive voltage 1 (VH1) of the pump elements 7 in the non-overlapping parts 4 in the above-described manner. Then, as a result, the flow rate of the liquid circulating in each of the first circulation flow paths 18 in the overlapping part 3 becomes greater the flow rate of the liquid circulating in each of the second circulation flow paths 19 in the non-overlapping parts 4. Therefore, this embodiment can minimize the risk of liquid viscosity rise in the overlapping parts 3 to in turn minimize the risk of producing images with uneven density and striped images formed by the liquid ejected from this embodiment of liquid ejection head. Therefore, the liquid ejection apparatus 200 in which the liquid ejection head 100 of this embodiment is mounted can form high quality images.

On the other hand, unlike the above-described first and second embodiments, the liquid flow rate is increased in this embodiment simply by applying a high drive voltage to the pump elements 7 in the overlapping parts 3 without modifying the positional arrangement of the pump elements 7. Thus, this embodiment allows the recording element substrates 1 to be manufactured with relative ease and a high yield to be achieved in the steps of manufacturing the recording element substrates 1. Additionally, since the pump elements 7 that require a high drive voltage (VH2) are limited only to those of the overlapping parts 3, the overall power consumption of the embodiment can be reduced. Then, as a result, it is possible to realize a power saving liquid ejection apparatus by mounting such a liquid ejection head 100 in the liquid ejection apparatus 200.

While two different power wiring arrangements are employed in the above description of this embodiment, the number of power wiring arrangements can arbitrarily be selected for the purpose of the present disclosure. The only requirement to be satisfied for the purpose of providing the advantageous effects of this embodiment is that the drive voltage of the pump elements 7 arranged in the overlapping parts 3 is higher than the drive voltage of the pump elements 7 arranged in the non-overlapping parts 4.

Modified Embodiment

Figure 8A:
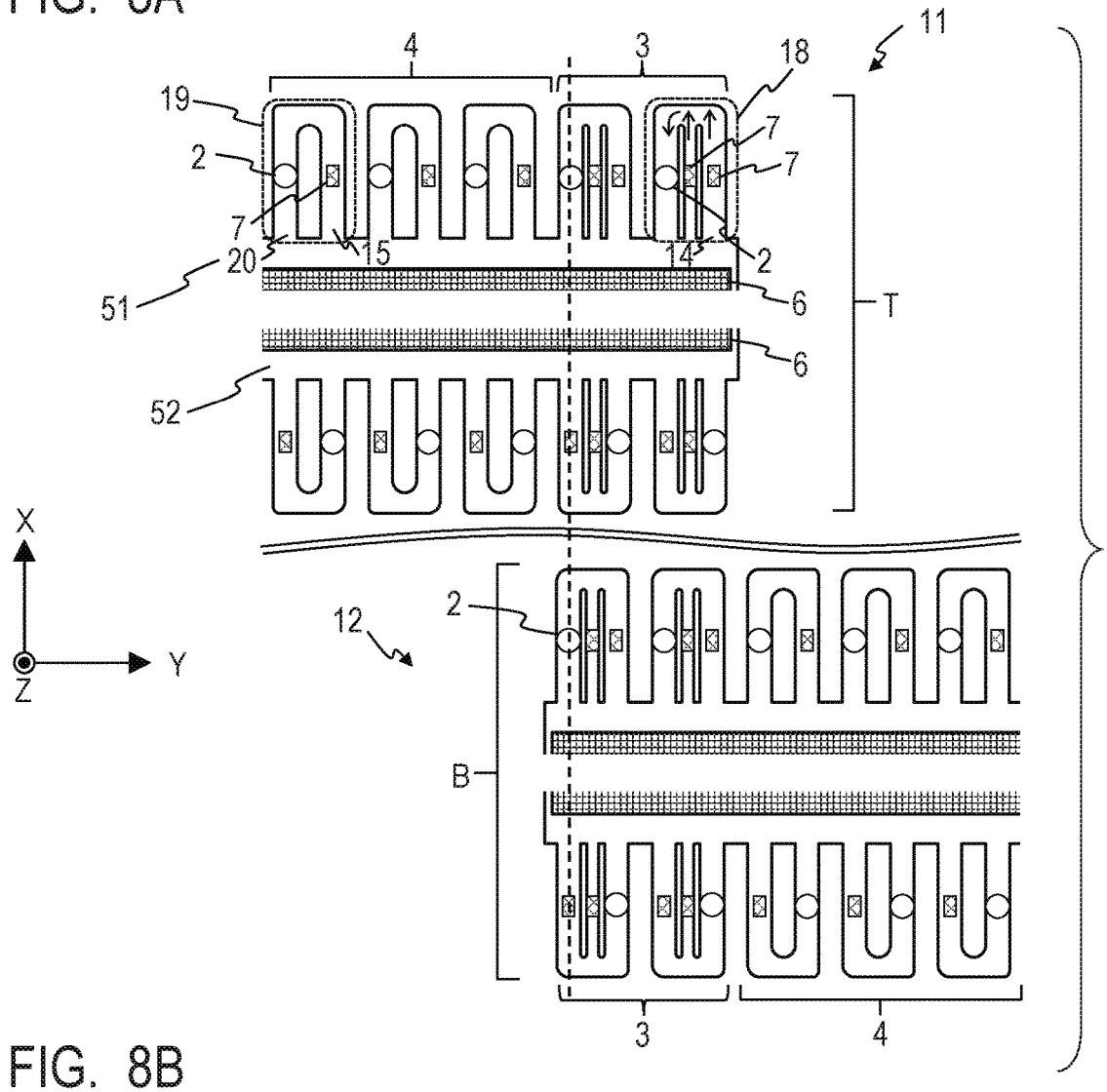
FIG. 8A is an enlarged schematic plan view of the overlapping parts and the non-overlapping parts of two neighboring recording element substrates of an embodiment obtained by modifying the third embodiment of liquid ejection head according to the present disclosure and FIG. 8B is a schematic illustration of the drive voltages of the overlapping parts and the drive voltages of the non-overlapping parts of the recording element substrates of the modified embodiment.

Now, an embodiment obtained by modifying the configuration of the pump elements of the overlapping parts and the configuration of the pump elements of the non-overlapping parts of the recording element substrates arranged in the liquid ejection head of the second embodiment will be described below by referring to FIGS. 8A and 8B. The recording element substrates 1 of this modified embodiment differ from the recording element substrates 1 of the above-described third embodiment in terms of the following point. Namely, different voltage values are selected for the drive voltage of the liquid ejection elements 9, the drive voltage of the pump elements 7 of the non-overlapping parts 4 and the drive voltage of the pump elements 7 of the overlapping parts 3. More specifically, drive voltage 1 (VH1) is selected for the first power wiring and drive voltage 2 (VH2) is selected for the second power wiring, while drive voltage 3 (VH3) is selected for the third power wiring and the relationship requirement of VH2<VH3 is satisfied in this modified embodiment. A relationship requirement is particularly defined neither between the drive voltage 1 (VH1) of the liquid ejection elements 9 and the drive voltage 2 (VH2) nor between the drive voltage 1 (VH1) and the drive voltage 3 (VH3).

Figure 8B:
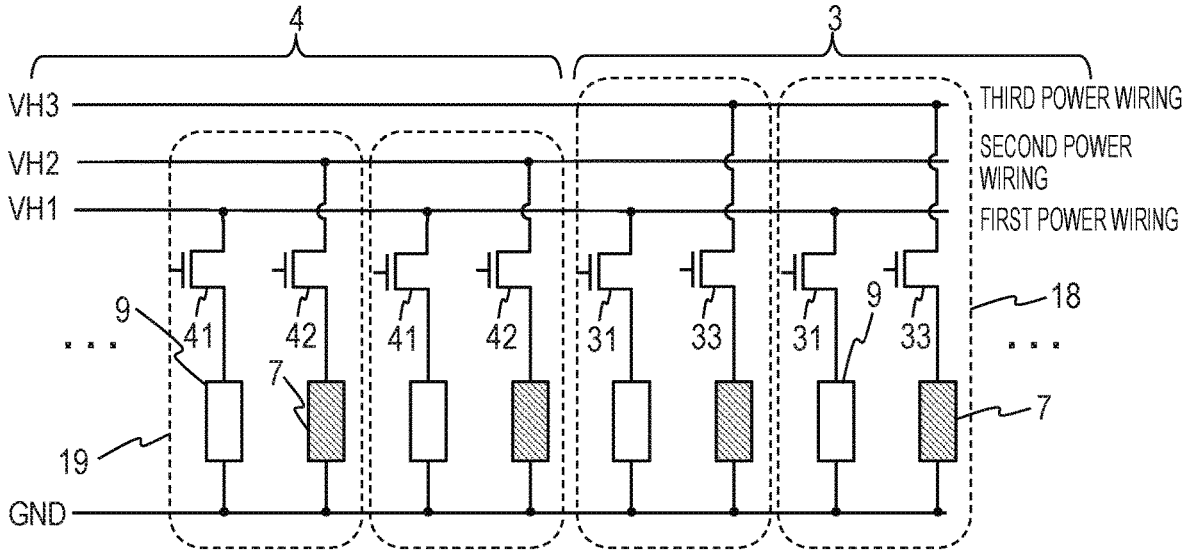

As shown in FIG. 8B, in each of the second circulation flow paths 19 in the non-overlapping parts 4, the liquid ejection element 9 is connected between the drive voltage for the first power wiring (VH1) and GND (ground) by way of a switching element 41 for driving the liquid ejection element 9 and, similarly, in each of the second circulation flow paths 19 in the non-overlapping parts 4, the pump element 7 is connected between the drive voltage for the second power wiring (VH2) and GND (ground) by way of a switching element 42 for driving the pump element 7. In each of the first circulation flow paths 18 in the overlapping parts 3, the liquid ejection element 9 is connected between the drive voltage for the first power wiring (VH1) and GND (ground) by way of a switching element 31 for driving the liquid ejection element 9 and, similarly, in each of the first circulation flow paths 18 in the overlapping parts 3, each of the pump elements 7 is connected between the drive voltage for the third power wiring (VH3) and GND (ground) by way of a switching element 33 for driving the pump element 7. In this way, the flow rate of the liquid circulating in each of the first circulation flow paths 18 is made greater than the flow rate of the liquid circulating in each of the second circulation flow paths 19 by making the drive voltage (VH3) for driving the pump elements 7 of the overlapping parts 3 higher than the drive voltage (VH2) for driving the pump elements 7 of the non-overlapping parts 4.

Therefore, this modified embodiment can minimize the risk of liquid viscosity rise in the overlapping parts 3 to in turn minimize the risk of producing images with uneven density and striped images formed by the liquid ejected from this modified embodiment of liquid ejection head. Thus, the liquid ejection apparatus 200 in which the liquid ejection head 100 of this modified embodiment is mounted can form high quality images. Additionally, in this modified embodiment, the pump element 7 in each of the first circulation flow paths 18 of the overlapping parts 3 is connected to the power wiring that differs from the power wiring to which the pump element 7 in each of the second circulation flow paths 19 of the non-overlapping parts 4 is connected and hence driven by a drive voltage that differs from the drive voltage of the pump element 7 in each of the second circulation flow paths 19. Thus, in addition to the advantageous effects of the third embodiment, this modified embodiment allows an appropriate drive voltage to be selected for the overlapping parts 3 and another appropriate drive voltage to be selected for the non-overlapping parts 4 to consequently reduce the power consumption of the modified embodiment.

Fourth Embodiment

Figure 9A:
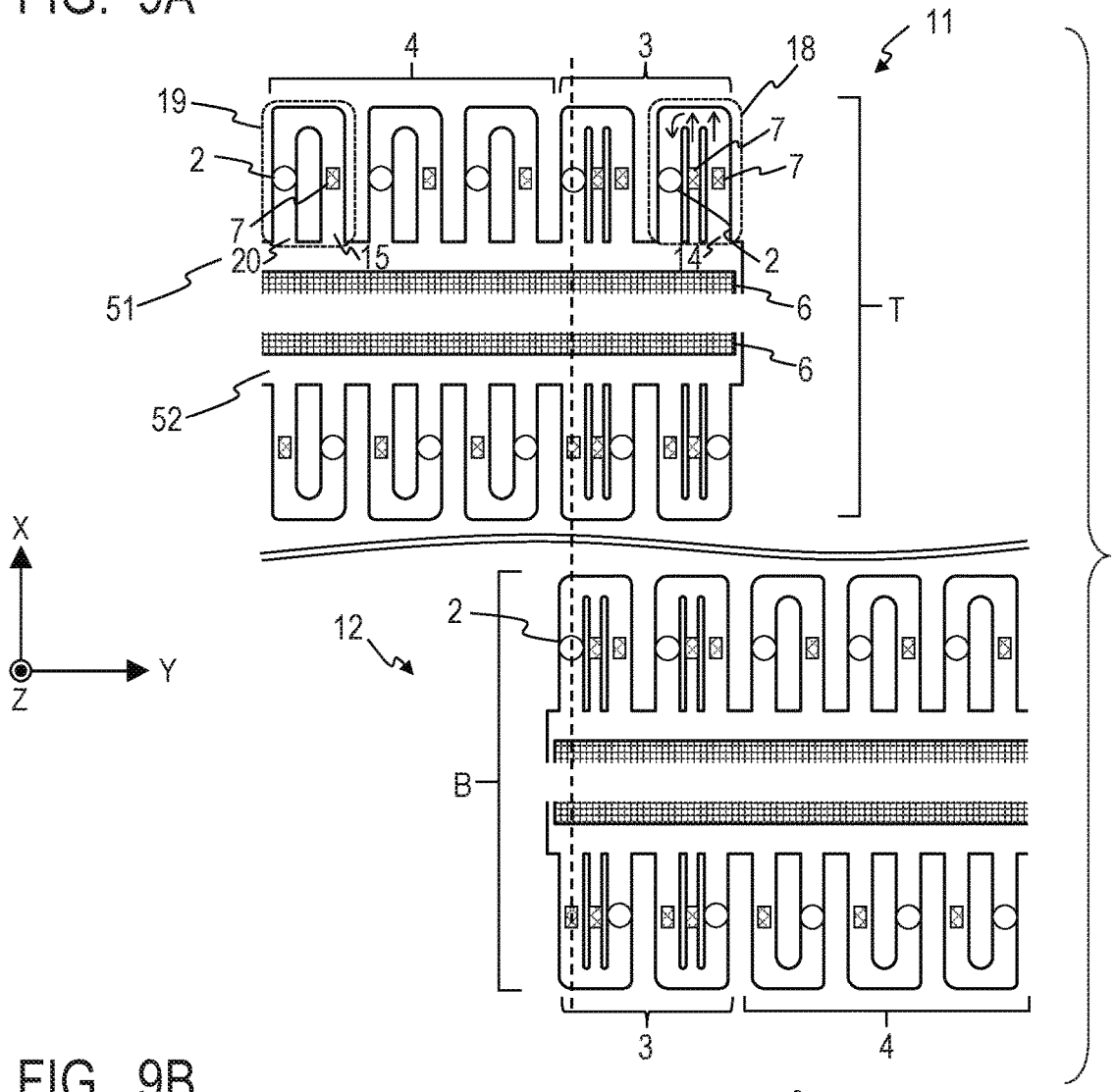
FIG. 9A is an enlarged schematic plan view of the overlapping parts and the non-overlapping parts of two neighboring recording element substrates of the fourth embodiment of liquid ejection head according to the present disclosure and FIG. 9B is a schematic illustration of the drive voltage of the overlapping parts and the drive voltage of the non-overlapping parts of the recording element substrates of the fourth embodiment of liquid ejection head.
Figure 9B:
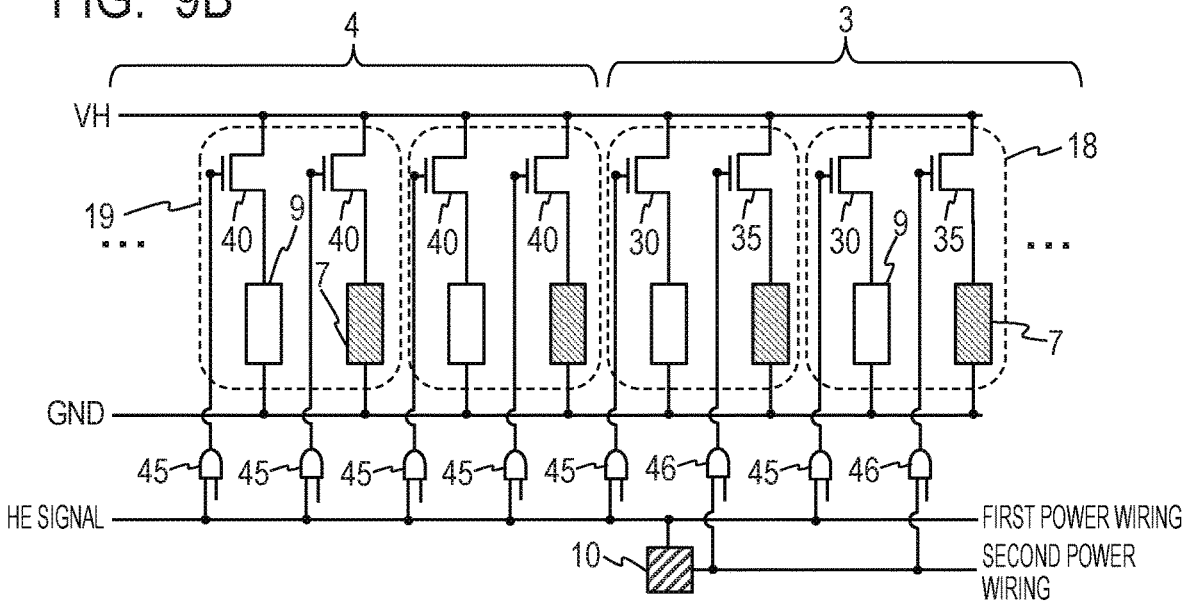

Now, the configuration of each of the overlapping parts and the configuration of each of the non-overlapping parts of the recording element substrates arranged in the fourth embodiment of liquid ejection head according to the present disclosure will be described below by referring to FIGS. 9A and 9B. When compared with the third embodiment, the fourth embodiment differs from the third embodiment in terms of the following point. The point of difference is that the drive signal for driving the pump elements 7 in the non-overlapping parts 4 differs from the drive signal for driving the pump elements 7 in the overlapping parts 3. As shown in FIG. 9B, in each of the second circulation flow paths 19 of the non-overlapping parts 4, the pump element 7 and the liquid ejection element 9 receive a drive signal by way of the first signal wiring. On the other hand, in each of the first circulation flow paths 18 of the overlapping parts 3, the liquid ejection element 9 receives a drive signal by way of the first signal wiring but each of the pump elements 7 receives a drive signal that is obtained by converting the drive signal input from the first signal wiring by means of signal conversion circuit 10 by way of the second signal wiring.

Each of the liquid ejection elements 9 and the pump elements 7 arranged in the non-overlapping parts 4 and the overlapping parts 3 repeats an ON/OFF action upon receiving a drive signal from the outside. Each of the recording element substrates 1 is provided with a signal conversion circuit 10. As a drive signal is input to the signal conversion circuit 10 by way of the first signal wiring, the signal conversion circuit 10 converts the signal by way of a predetermined signal conversion process and outputs the drive signal obtained by the signal conversion to the second signal wiring as a new drive signal. More specifically, the signal conversion circuit 10 converts the input drive signal into a driven signal that drives the pump elements 7 for a prolonged period of time. Specific examples of signal conversions for converting an input drive signal into a different drive signal that drives the pump elements 7 for a prolonged period of time include a signal conversion of increasing the pulse width of the input drive signal and a signal conversion of increasing the number of pulses of the input drive signal.

Then, as a result of such a signal conversion, the pump elements 7 arranged in the overlapping parts 3 are driven to operate for a longer period of time than the pump elements 7 arranged in the non-overlapping parts 4 to consequently prolong the duration of liquid circulation in the overlapping parts 3. Additionally, the average calorific value of the heat generated per unit time by each of the pump elements 7 arranged in the overlapping parts 3 becomes greater than the average calorific value of the heat generated per unit time by each of the pump elements 7 arranged in the non-overlapping parts 4. Then, as a result, the flow rate of the liquid circulating in each of the first circulation flow paths 18 is made greater than the flow rate of the liquid circulating in each of the second circulation flow paths 19. Therefore, this embodiment can minimize the risk of liquid viscosity rise in the overlapping parts 3 to in turn minimize the risk of producing images with uneven density and striped images by the liquid ejected from this embodiment of liquid ejection head. Thus, the liquid ejection apparatus 200 in which the liquid ejection head 100 of this modified embodiment is mounted can form high quality images.

The liquid ejection element 9 in each of the second circulation flow paths 19 of the non-overlapping parts 4 is connected between the drive voltage VH and GND (ground) by way of the output of a logic circuit element 45 (AND circuit in FIG. 9B) for driving the liquid ejection element 9. The pump element 7 in each of the second circulation flow paths 19 of the non-overlapping parts 4 is connected between the drive voltage VH and GND (ground) by way of the output of a login circuit element 45 (AND circuit in FIG. 9B) for driving the pump element 7. The liquid ejection element 9 in each of the first calculation flow paths 18 of the overlapping parts 3 is connected between the drive voltage VH and GND (ground) by way of the output of a logic circuit element 45 for driving the liquid ejection element 9. On the other hand, the pump element 7 in each of the first circulation flow paths 18 of the overlapping parts 3 is connected between the drive voltage VH and GND (ground) by way of the output of a logic circuit element 46 (AND circuit in FIG. 9B) for driving the pump element 7. In general, the input terminal of each of the switching elements for driving a pump element 7 or a liquid ejection element 9 is connected to the output terminal of a logic circuit element 45 or 46.

An HE (heat) signal is input to one of the input terminals of each of the logic circuit elements 45 that is connected to either the liquid ejection element 9 or the pump element 7 in each of the second circulation flow paths 19 of the non-overlapping parts 4 by way of the first signal wiring and also to one of the input terminals of each of the logic circuit elements 45 that is connected to the liquid ejection element 9 in each of the first circulation flow paths 18 of the overlapping parts 3 by way of the first signal wiring. A timing signal output from a shift register or a latch circuit (not shown) is input to the other input terminal of each of the logic circuit elements 45. The timing signal is for outputting an "H" level signal at the timing same as the timing at which the HE signal is output. With this arrangement, the pulse waveform applied to the liquid ejection elements 9 and the pump elements 7 is controlled.

The HE (heat) signal that is input by way of the first signal wiring is converted into a new drive signal by the signal conversion circuit 10, which new drive signal is then input to one of the input terminals of each of the logic circuit elements 46 that is connected to the pump element 7 in each of the first circulation flow paths 18 of the overlapping parts 3. A timing signal output from a shift register or a latch circuit (not shown) is input to the other input terminal of each of the logic circuit elements 46. The timing signal is for outputting an "H" level signal at the timing same as the timing at which the above-described HE (heat) signal is output.

The signal conversion that is performed in this embodiment is such that a pulse waveform is generated by the signal conversion and the generated pulse waveform operates to drive the pump elements 7 in the overlapping parts 3 for a long period of time so as to prolong the duration of liquid circulation. Differently stated, this embodiment performs signal conversion for reinforcing the drive signal to be applied only to the pump elements 7 arranged in the overlapping parts 3 to minimize the increase of power consumption required for such drive signal reinforcement. Additionally, this embodiment performs signal conversion of drive signal by means of a signal conversion circuit 10 arranged in each of the recording element substrates 1 without providing a new signal for reinforcing the drive signal for driving the pump elements 7. This arrangement facilitates signal conversion. Thus, this embodiment employs a drive signal for driving the pump elements 7 in the non-overlapping parts 4 that is different from the drive signal for driving the pump elements 7 in the overlapping parts 3. In other words, different drive signals can appropriately and selectively be employed in this embodiment and at the same time, this embodiment can reduce the power consumption.

Fifth Embodiment

Figure 10A:
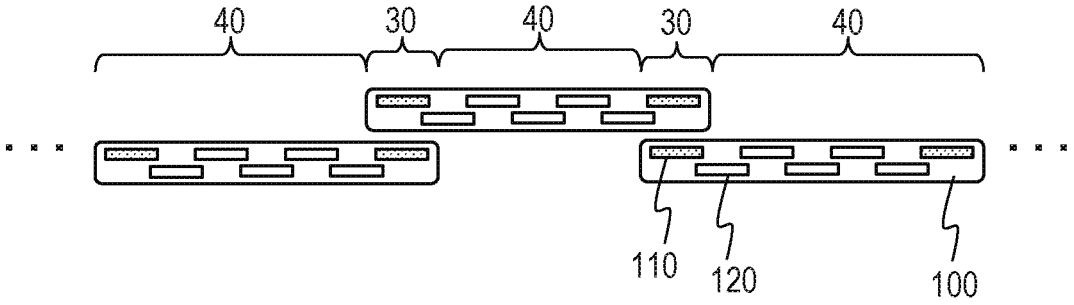
FIGS. 10A and 10B are schematic plan views of some of the liquid ejection heads of the fifth embodiment of liquid ejection apparatus according to the present disclosure.

The fifth embodiment of the present disclosure is a liquid ejection apparatus. The positional arrangement of liquid ejection heads of the liquid ejection apparatus of the fifth embodiment of the present disclosure will be described below by referring to FIGS. 10A and 10B. As shown in FIG. 10A, this embodiment has a plurality of liquid ejection heads 100, each having a plurality of recording element substrates 110 and a plurality of recording element substrates 120 arranged therein. Each of the recording element substrates 110 and 120 has overlapping parts 3 and non-overlapping parts 4. The plurality of liquid ejection heads 100 are arranged such that any two neighboring liquid ejection heads 100 partly overlap each other. Each of the liquid ejection heads 100 has a non-overlapping region 40 and an overlapping region 30 or two overlapping regions 30. In the liquid ejection apparatus in which a plurality of liquid ejection heads 100 are mounted to form a recording section 202 (see FIG. 2A), the positional arrangement of the liquid ejection heads 100 can appropriately be modified to make the recording section 202 have a length that matches the width of the recording medium to be used with the recording section 202. Therefore, this liquid ejection apparatus is suited to form images on recording mediums having a large width. Preferably, a recording element substrate 11 and a recording element substrate 12, both of which have pump elements 7 and circulation flow paths therein as described above for the preceding embodiments, are employed for the recording element substrates 110 arranged at the longitudinal opposite ends of each of the liquid ejection heads 100. Any two neighboring liquid ejection heads 100 have respective overlapping regions 30 that overlap each other. Additionally, since pump elements 7 and circulation flow paths described above in each of the embodiments are arranged in each of the recording element substrates 110 located in the overlapping regions 30, the unevenness, if any, along the joint line of two partial images formed by two neighboring liquid ejection heads 100 can be minimized. Thus, this embodiment provides a liquid ejection apparatus that can produce high quality images.

Figure 10B:
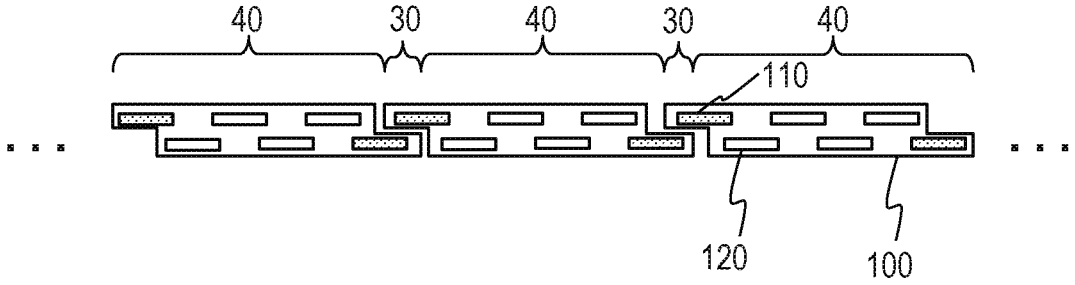

The liquid ejection heads 100 may not necessarily be arranged in a staggered manner as shown in FIG. 10A. In other words, each of the liquid ejection heads 100 may be made to show a stepped profile such that the neighboring lateral edges of any two adjacently located liquid ejection heads 100 snugly fit to each other and all the liquid ejection heads 100 are precisely aligned to form a single row of liquid ejection heads 100 as shown in FIG. 10B. In other words, liquid ejection heads 100 having such a stepped profile are advantageous from the viewpoint of image formation because they form a pseudo single line head.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-189396, filed Oct. 16, 2019, which is hereby incorporated by reference herein in its entirety.

What is claimed is:

1. A liquid ejection head comprising:

a plurality of ejection orifices for ejecting liquid, a liquid supply flow path for supplying liquid to the plurality of ejection orifices and a plurality of branch flow paths branched from the liquid supply flow path, each of the plurality of branch flow paths being held in communication with corresponding one of the plurality of ejection orifices;

the plurality of ejection orifices forming a first row of ejection orifices and a second row of ejection orifices extending in parallel with each other, each of the first row of ejection orifices and the second row of ejection orifices having an overlapping part overlapping with the corresponding overlapping part of the other row of ejection orifices and a non-overlapping part not overlapping with any of the ejection orifices of the other row of ejection orifices as viewed in the direction orthogonal relative to the first and second rows of ejection orifices, the plurality of branch flow paths including first branch flow paths held in communication with the ejection orifices located in the overlapping part and second branch flow paths held in communication with the ejection orifices located in the non-overlapping part;

the flow rate of the liquid flowing through each of the first branch flow paths configured to be greater than the flow rate of the liquid flowing through each of the second branch flow paths.

2. The liquid ejection head according to claim 1, wherein each of the first branch flow paths and a corresponding merging flow path joining the liquid supply flow path form a first circulation flow path, and each of the first circulation flow paths has therein a first pump element for driving the liquid in the first circulation flow path to circulate.

3. The liquid ejection head according to claim 2, wherein each of the second branch flow paths and a corresponding merging flow path joining the liquid supply flow path form a second circulation flow path, and each of the second circulation flow paths has therein a second pump element for driving the liquid in the second circulation flow path to circulate.

4. The liquid ejection head according to claim 3, wherein the number of first pump elements per circulation flow path is greater than the number of second pump elements per circulation flow path.

5. The liquid ejection head according to claim 4, wherein each of the first branch flow paths has a plurality of sub flow paths extending in parallel with each other and each of the sub flow paths has a first pump element.

6. The liquid ejection head according to claim 3, wherein the first pump elements are configured to be driven by a drive voltage higher than the drive voltage for driving the second pump elements.

7. The liquid ejection head according to claim 3, wherein the first pump elements are configured to be driven for a period of time longer than the period of time of driving the second pump elements.

8. The liquid ejection head according to claim 2, wherein each of the second branch flow paths has a dead end behind its ejection orifice.

9. The liquid ejection head according to claim 8, wherein each of the first branch flow paths is shared by a plurality of first merging flow paths.

10. The liquid ejection head according to claim 9, wherein each of the first branch flow paths is located outside the corresponding first row of ejection orifices or the corresponding second row of ejection orifices.

11. A liquid ejection apparatus comprising a liquid ejection head, the liquid ejection head comprising:

a plurality of ejection orifices for ejecting liquid, a liquid supply flow path for supplying liquid to the plurality of ejection orifices and a plurality of branch flow paths branched from the liquid supply flow path, each of the plurality of branch flow paths being held in communication with corresponding one of the plurality of ejection orifices;

the plurality of ejection orifices forming a first row of ejection orifices and a second row of ejection orifices extending in parallel with each other, each of the first row of ejection orifices and the second row of ejection orifices having an overlapping part overlapping with the corresponding overlapping part of the other row of ejection orifices and a non-overlapping part not overlapping with any of the ejection orifices of the other row of ejection orifices as viewed in the direction orthogonal relative to the first and second rows of ejection orifices, the plurality of branch flow paths including first branch flow paths held in communication with the ejection orifices located in the overlapping part and second branch flow paths held in communication with the ejection orifices located in the non-overlapping part;

the flow rate of the liquid flowing through each of the first branch flow paths configured to be greater than the flow rate of the liquid flowing through each of the second branch flow paths.

12. A liquid ejection apparatus comprising a plurality of liquid ejection heads, each of the plurality of liquid ejection heads comprising:

a plurality of ejection orifices for ejecting liquid, a liquid supply flow path for supplying liquid to the plurality of ejection orifices and a plurality of branch flow paths branched from the liquid supply flow path, each of the plurality of branch flow paths being held in communication with corresponding one of the plurality of ejection orifices;

the plurality of ejection orifices forming a first row of ejection orifices and a second row of ejection orifices extending in parallel with each other, each of the first row of ejection orifices and the second row of ejection orifices having an overlapping part overlapping with the corresponding overlapping part of the other row of ejection orifices and a non-overlapping part not overlapping with any of the ejection orifices of the other row of ejection orifices as viewed in the direction orthogonal relative to the first and second rows of ejection orifices, the plurality of branch flow paths including first branch flow paths held in communication with the ejection orifices located in the overlapping part and second branch flow paths held in communication with the ejection orifices located in the non-overlapping part, the flow rate of the liquid flowing through each of the first branch flow paths configured to be greater than the flow rate of the liquid flowing through each of the second branch flow paths, wherein the plurality of liquid ejection heads being arranged in parallel with the first and second rows of ejection orifices, any two adjacently located liquid ejection heads partly overlapping each other as viewed in the direction orthogonal relative to the first and second rows of the ejection orifices.

* * * * *